US007180491B1

(12) United States Patent
Moore et al.

(10) Patent No.: US 7,180,491 B1
(45) Date of Patent: Feb. 20, 2007

(54) APPLICATION AND METHOD FOR REJECTION OF A FALSE DATA ENABLE SIGNAL DURING VERTICAL BLANKING PERIODS IN A GRAPHICS SYSTEM

(75) Inventors: Bruce C. Moore, Glendale, AZ (US); Richard Alexander Erhart, Tempe, AZ (US); Donald E. Camp, Peoria, AZ (US); Mark Kuhns, Peoria, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 460 days.

(21) Appl. No.: 10/268,055

(22) Filed: Oct. 8, 2002

(51) Int. Cl.
*G09G 3/36* (2006.01)

(52) U.S. Cl. ..... 345/89; 345/87; 345/58; 345/98; 345/99; 345/204; 345/208; 345/213; 348/510; 348/511; 348/512; 348/516

(58) Field of Classification Search ..... 345/204, 345/98–100, 92–96, 87, 214, 89, 54, 208, 345/211–213, 58; 348/510–512, 516, 545, 348/547, 435.1, 476–478
See application file for complete search history.

(56) References Cited

U.S. PATENT DOCUMENTS 4,475,124 A * 10/1984 Ankeny et al. ..... 348/569
5,592,194 A * 1/1997 Nishikawa ..... 345/667
6,515,646 B2 * 2/2003 Tokonami et al. ..... 345/96
6,600,469 B1 * 7/2003 Nukiyama et al. ..... 345/87
6,791,518 B2 * 9/2004 Furukoshi ..... 345/87

OTHER PUBLICATIONS

Janardhanan et al. (Pub No.: US 2003/0234774).*

* cited by examiner

*Primary Examiner*—Richard Hjerpe
*Assistant Examiner*—Jennifer T. Nguyen
(74) *Attorney, Agent, or Firm*—Merchant & Gould P.C.; Timothy P. Sullivan

(57) ABSTRACT

A false DE rejection system is described. DEs are ignored during a programmable vertical lockout period. Internal timing is used during the vertical lockout period to count the number of vertical lines to ignore. The first DE received after the vertical lockout period signifies the start of the next graphics frame. Default video is output during the vertical lockout period. The TCON is synchronized to the start of the graphics frame. A horizontal line length timer measures the timing for the horizontal line length. The horizontal line length timer may also keep a moving average of all of the lines that it has measured. This helps to ensure that the TCON does not get out-of-sync with the input stream during the vertical blanking periods. The DE rejection system includes automatic blanking detection that ignores DEs that occur after the end of a predetermined graphics frame. The vertical lockout does not occur until there has been no DE for an entire line.

21 Claims, 3 Drawing Sheets

APPLICATION AND METHOD FOR REJECTION OF A FALSE DATA ENABLE SIGNAL DURING VERTICAL BLANKING PERIODS IN A GRAPHICS SYSTEM

FIELD OF THE INVENTION

The present invention is related to electronic circuits, and more specifically to graphics circuits relating to blanking.

BACKGROUND OF THE INVENTION

Display system Timing Controller (TCON) electronics accept control and data from upstream graphics generation electronics and reformat them to fit the requirements of the row and column drivers used to drive displays. The Data Enable (DE) signal is the control mechanism used to indicate when graphics data is actively being transmitted to the TCON. The DE signal is active (logic one state) when data is being transmitted, and is inactive (logic zero state) during periods when no data is being transmitted. Periods of time in a horizontal line when data is not being transmitted is referred to as horizontal blanking. Lines within a graphics frame when data is not being transmitted are referred to as vertical blanking lines.

Some graphics generators, however, do not follow this protocol. Instead, they may send a false DE signal sometime during the vertical blanking period. Data driven during the false DE is not meant to be displayed.

Without a means to handle a false DE, a TCON may accept the false DE as a valid DE, and will not remain synchronized to the actual graphics data and control. This could result in undesired visual artifacts on the display, such as sections of missing data or data being scrolled down the screen.

SUMMARY OF THE INVENTION

Briefly described, the present invention is directed at providing an apparatus and method that rejects false DE signals.

According to one aspect of the invention, DEs are ignored during a vertical lockout period. Internal timing is used during the vertical lockout period to count the number of vertical lines to ignore. The first DE received after the vertical lockout period signifies the start of the next graphics frame.

According to another aspect of the invention, the vertical lockout period is programmable. The lockout period may be stored in an EEPROM, ROM, RAM, and the like.

According to another aspect of the invention, default video is output during the vertical lockout period.

According to yet another aspect of the invention, the TCON is synchronized to the start of the graphics frame. The TCON looks for blanking to be declared and then waits for a predetermined number of DEs to occur before horizontal synchronization occurs.

Accord to yet another aspect of the invention, a horizontal line length timer measures the timing for the horizontal line length. The horizontal line length timer may also keep a moving average of all of the lines that it has measured. This helps to ensure that the TCON does not get out-of-sync with the input stream during the vertical blanking periods.

According to still yet another aspect of the invention, the DE rejection system includes automatic blanking detection that ignores DEs that occur after the end of a predetermined graphics frame. The vertical lockout does not occur until there has been no DE for an entire line.

DETAILED DESCRIPTION OF THE PREFERRED EMBODIMENT

Figure 1:
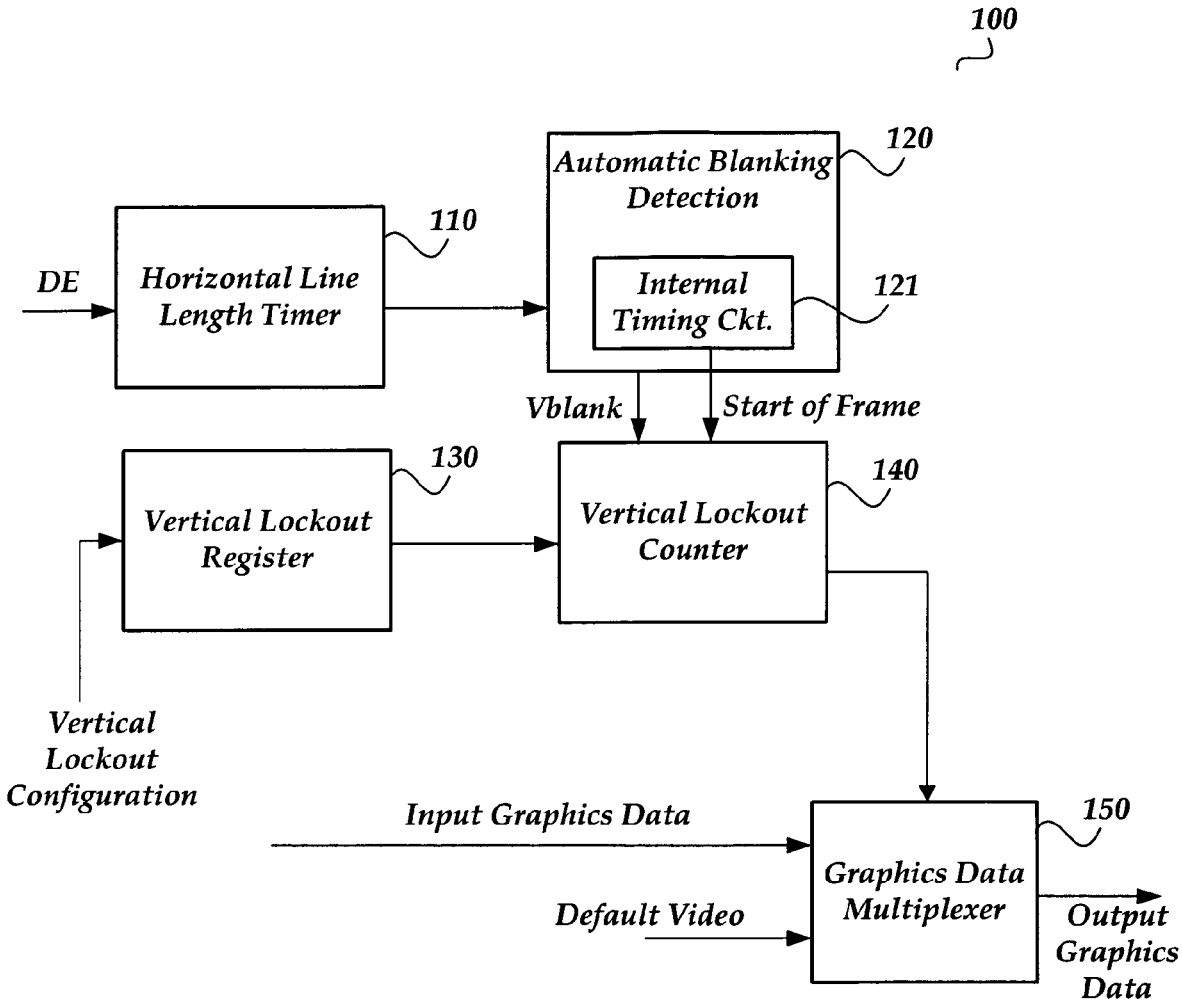
FIG. 1 illustrates a schematic diagram of a false DE rejection system.

In the following detailed description of exemplary embodiments of the invention, reference is made to the accompanied drawings, which form a part hereof, and which is shown by way of illustration, specific exemplary embodiments of which the invention may be practiced. These embodiments are described in sufficient detail to enable those skilled in the art to practice the invention, and it is to be understood that other embodiments may be utilized, and other changes may be made, without departing from the spirit or scope of the present invention. The following detailed description is, therefore, not to be taken in a limiting sense, and the scope of the present invention is defined only by the appended claims.

Throughout the specification and claims, the following terms take the meanings explicitly associated herein, unless the context clearly dictates otherwise. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected or an indirect connection through one or more passive or active intermediary devices. The term "circuit" means either a single component or a multiplicity of components, either active and/or passive, that are coupled together to provide a desired function. The term "signal" means at least one current, voltage, or data signal. The term "DE" means a data enable signal. Referring to the drawings, like numbers indicate like parts throughout the views.

Briefly described, the present invention is directed at providing an apparatus and method that rejects false DE signals. Any DE within the input graphics stream during a programmable vertical lockout period is ignored.

FIG. 1 illustrates a schematic diagram of a false DE rejection system in accordance with aspects of the invention. As shown in the figure, false DE rejection system 100 includes Horizontal Line Length Timer 110, automatic Blanking Detection 120, Vertical Lockout Register 130, Vertical Lockout Counter 140, and Graphics Data Multiplexer 150.

Automatic blanking detection 120 is utilized to detect the start of vertical blanking of a graphics data stream. It accomplishes this by looking for the absence of the start of DE signaling for two consecutive line times as determined by Horizontal Line Length Timer (HLLT) 110. Automatic Blanking Detection 120 may include an internal timing circuit 121 to generate a timing signal to indicate the start of a frame. In this example embodiment, the timing signal is the Start of Frame indication signal shown in FIG. 1. Automatic Blanking Detection 120 may also count the number of lines in frame. According to one embodiment, if automatic blanking detection 120 continues to receive DEs after the end of the expected frame the DEs are ignored. The end of the expected frame is based on the resolution of the frame. For example, for XGA 768 active lines per frame are expected. If DEs are received after the 769 lines (for the XGA example) then they are ignored.

HLLT 110 learns the timing used by DE during active lines, and creates this timing in the absence of DE timing during vertical lockout periods. Therefore, line timing is continued during the lockout periods. HLLT 110 not only measures the timing of the horizontal line but may also keep a moving average of the timing values. The averaging helps to ensure that different length horizontal lines are accounted for in the timing.

Vertical Lockout Register 130 may be programmed with the programmable period utilized to lockout false DEs upon identification of the start of vertical blanking. According to one embodiment of the invention, the lockout period is at least two lines less than the actual vertical blanking period. For example, if the vertical blanking period is twenty six lines, then the lockout period would be programmed to 24 or fewer lines.

Vertical Lockout Counter 140 counts the number of lines in a frame starting when Automatic Blanking Detection 120 provides the start of frame indication signal.

Graphics Data Multiplexer 150 multiplexes the graphics data stream with default video during periods of vertical blanking and during initialization and synchronization to the graphics frame timing. During normal operation the graphics data is output.

During an initialization period for the false DE rejection system, the TCON synchronizes to the graphics frame timing without locking to a false DE instead of to the actual start of frame. According to one embodiment of the invention, DEs are not to be placed in the last two lines of vertical blanking. The absence of the start of a new line for two consecutive line times helps to ensure that the TCON will identify the true Start of Frame. Synchronization is completed when a predetermined number of consecutive DEs have been detected starting from a vertical blanking state. According to one embodiment of the invention, the predetermined number of consecutive DEs is two. No vertical lockout is performed during the initialization process. Once the TCON is synchronized horizontally, vertical lockout is performed with vertical synchronization being achieved with the next DEs detection.

After synchronization to the graphics frame timing, the vertical lockout function is enabled. This function is implemented by using the vertical line counter (140) to indicate when the start of vertical blanking occurs. Once blanking has started, Vertical Lockout Counter 140 ignores any activity on the DE signal for as many lines as specified in Vertical Lockout Register 130, using generated line timing from Horizontal Line Length Timer 110 as the timing reference due to the lack of timing from the DE signal during blanking. Following the vertical lockout time period, the first active DE will signify the start of the next frame.

Figure 2:
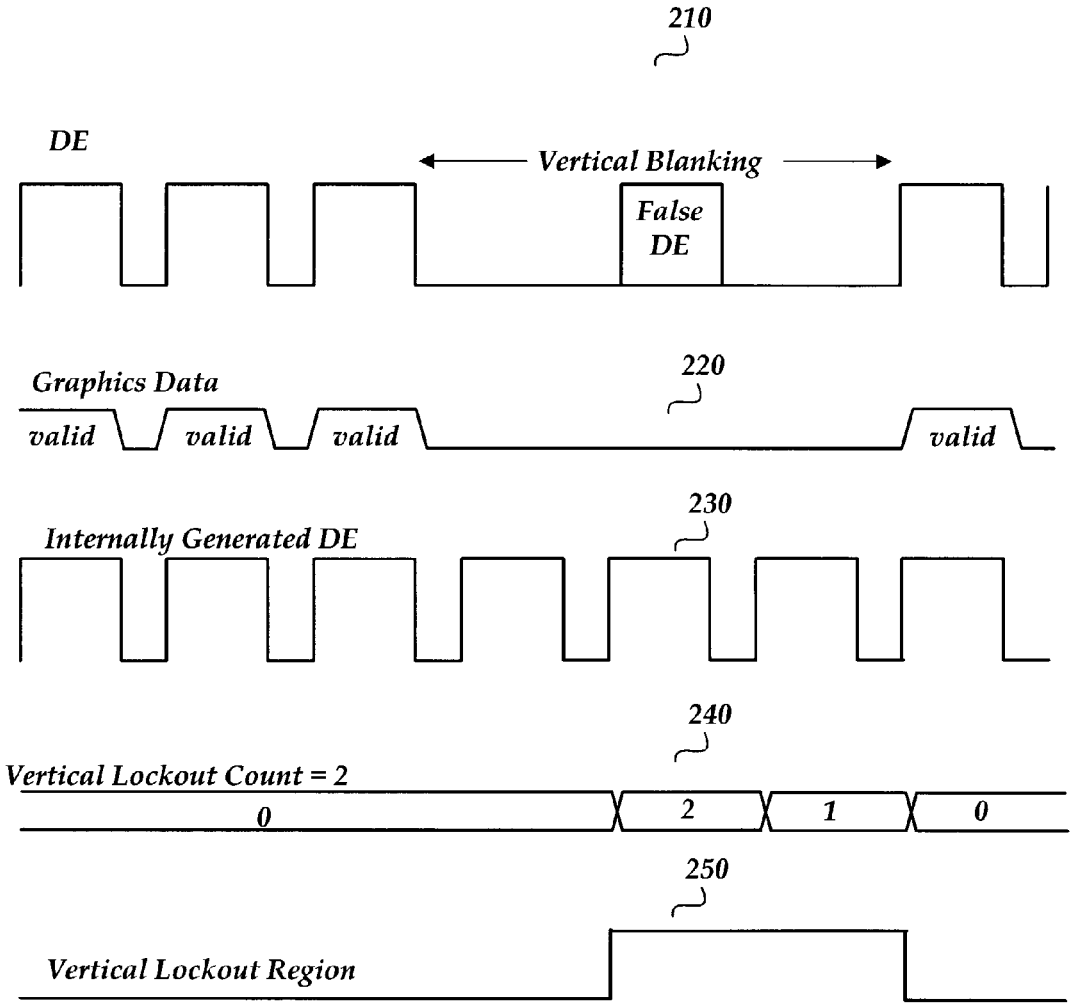
FIG. 2 shows timing diagrams illustrating operation of the false DE rejection system.

FIG. 2 shows timing diagrams illustrating operation of the false DE rejection system, in accordance with aspects of the invention. Block 210 illustrates an exemplary DE signal. A vertical blanking period is illustrated in which a false DE is illustrated. The false DE is ignored as it is in the vertical lockout region as illustrated by block 250.

Block 220 illustrates an exemplary graphics data signal. As can be seen referring to block 220, graphics data is not valid during the vertical blanking period.

Block 230 illustrates an internally generated DE signal, in accordance with aspects of the invention. The internally generated DE signal relates to the average horizontal line length of the system and is used as a timing reference during the vertical lockout region.

Block 240 illustrates an exemplary vertical lockout count of two DE signals. Once the method and system have detected the start of a DE for one line time, the vertical lockout function is started and a countdown begins. According to one embodiment of the invention, the vertical lockout period is ended when the vertical lockout count equals zero. Any counting or timing scheme may be used to measure the vertical lockout region.

Figure 3:
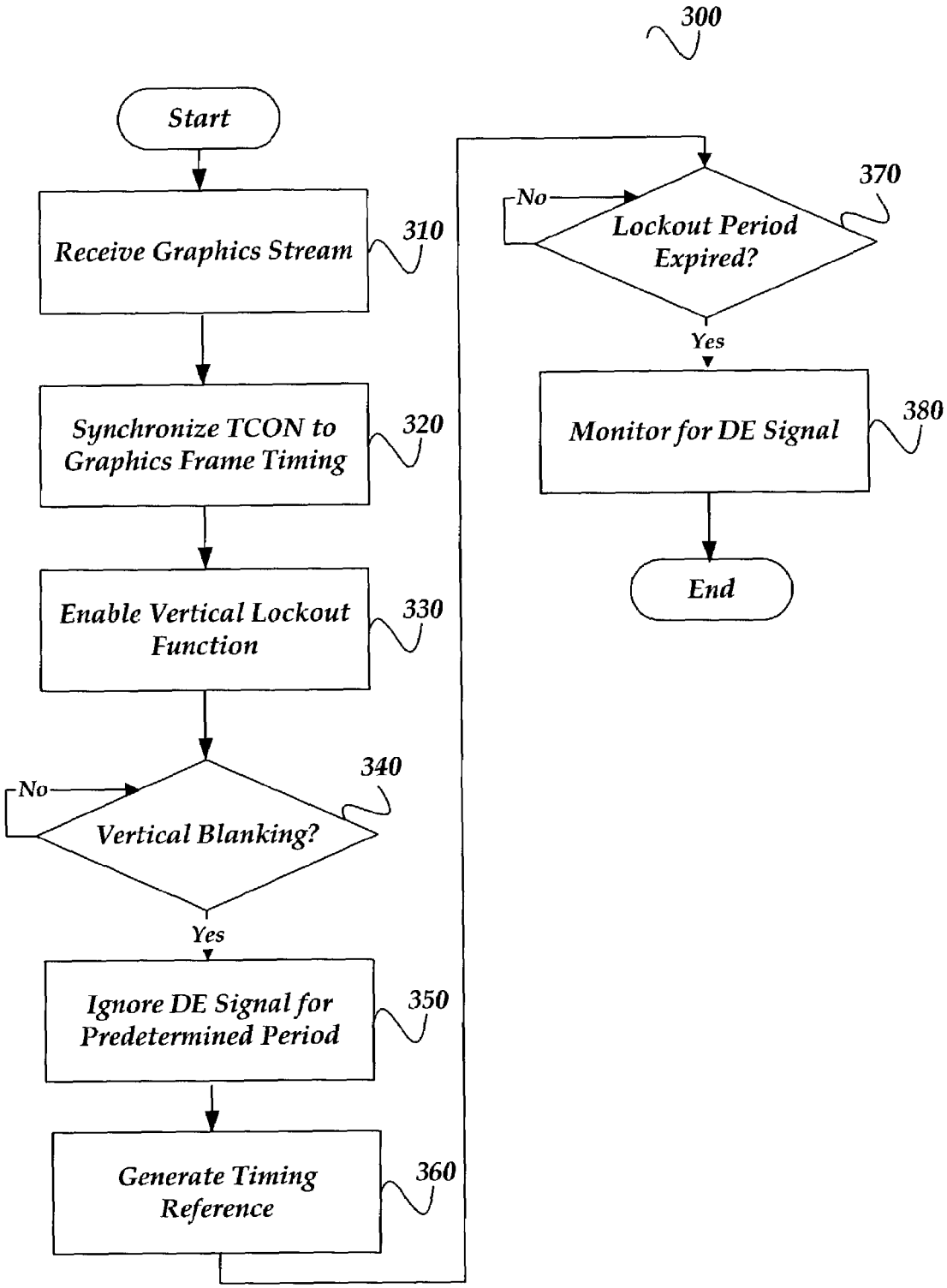
FIG. 3 illustrates a process diagram of the operation a false DE rejection system, in accordance with aspects of the invention.

FIG. 3 illustrates a process diagram of the operation a false DE rejection system, in accordance with aspects of the invention. The process is applied to a graphics data stream in the following manner to achieve rejection of a false DE.

After a start block, the process moves to block 310 where a graphics stream is received. Moving to block 320, the TCON is synchronized to the graphics frame timing. An initialization period is used to determine timing characteristics associated with the graphics stream. During initialization, the TCON synchronizes to the graphics frame timing without locking to the false DE instead of the actual start of frame.

After synchronizing to the graphics frame timing, the process moves to block 330 where the vertical lockout function is enabled. Transitioning to decision block 340, a determination is made as to when the start of vertical blanking occurs. When vertical blanking has not occurred, the process continues to determine monitor.

When vertical blanking has started, the process moves to block 350 where the DE signal is ignored for a predetermined period of time. According to one embodiment of the invention, the predetermined time relates to a number of lines. During the time the DE signal is ignored, the process moves to block 360 where a timing reference is used to generate line timing during this period.

Moving to decision block 370, a determination is made as to whether the lockout period has expired. When the lockout period has not expired, the process continues to ignore the DE signal. When the lockout period has expired, the process moves to block 380 to monitor for a DE signal. A received DE signal after the lockout period indicates the start of the next graphics frame.

The process then moves to an end block and returns to processing other actions.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An apparatus for rejecting a false data enable (DE) in a graphics system, comprising:

an automatic blanking detection circuit arranged to receive a DE signal and determine when a vertical blanking period begins, and in response to the beginning of the vertical blanking period generate a start of vertical blanking signal; wherein the automatic blanking detection circuit comprises an internal timing circuit configured to generate a timing signal during the vertical blanking period and output the timing signal; and a vertical lockout counter circuit arranged to receive the vertical blanking signal and the timing signal, and configured to ignore the DE signal during a vertical lockout period and in response to the timing signal count the vertical lockout period.

2. The apparatus of claim 1, wherein the vertical lockout period is programmable.

3. The apparatus of claim 2, further comprising a vertical lockout register that is configured to receive a signal relating to the vertical lockout period and output a signal relating to the vertical lockout period to the vertical lockout counter, wherein the vertical lockout counter is further configured to receive the signal relating to the vertical lockout period.

4. The apparatus of claim 3, wherein the vertical lockout period relates to a number of lines in the vertical blanking period.

5. The apparatus of claim 4, wherein the vertical lockout period is at least two lines less than the vertical blanking period.

6. The apparatus of claim 2, wherein the automatic blanking detection circuit further comprises an internal timing circuit configured to generate a timing signal during the vertical blanking period and output the timing signal to the vertical lockout counter, wherein the vertical lockout counter is further configured to receive the timing signal, and in response to the timing signal count the vertical lockout period.

7. The apparatus of claim 1, further comprising a horizontal line length timer configured to receive the DE signal and arranged to time the length of the horizontal line, and in response output a horizontal line length signal to the automatic blanking detection circuit, wherein the automatic blanking detection circuit is further configured to receive the horizontal line length signal.

8. The apparatus of claim 7, wherein the timing signal is based on the time of the horizontal line length.

9. The apparatus of claim 7, wherein the time of the horizontal line length is a moving average of the horizontal line length.

10. The apparatus of claim 1, further comprising a graphics data multiplexer configured to receive a signal output from the vertical lockout counter relating to the vertical lockout period, and in response, configured to output default video during the vertical lockout period, otherwise output graphics data.

11. A method for rejecting a false data enable (DE), comprising:

receiving a DE signal at an automatic blanking detection circuit;

determining the occurrence of a vertical blanking period;

generating a vertical blanking signal using the automatic blanking detection circuit in response to the occurrence of the vertical blanking period;

generating a timing signal using a timing circuit internal to the automatic blanking detection circuit during the vertical blanking period;

counting a predetermined lockout period in response to the timing signal; and locking out the DE signal during the lockout period.

12. The method of claim 11, further comprising synchronizing a timing controller (TCON) to a graphics frame timing.

13. The method of claim 12, further comprising enabling a vertical lockout function after the synchronization.

14. The method of claim 11, wherein the timing signal is based on a time of the horizontal line length.

15. The method of claim 14, wherein the time of the horizontal line length is a moving average of the horizontal line length.

16. The method of claim 11, further comprising outputting a default video signal during the lockout period.

17. The method of claim 11, wherein the lockout period is programmable.

18. The method of claim 17, wherein the timing signal is based on a horizontal line length.

19. The method of claim 18, wherein the horizontal line length relates to a moving average of horizontal line lengths.

20. An apparatus for rejecting a false data enable (DE), comprising:

means for receiving a DE signal at an automatic blanking detection circuit;

means for determining the occurrence of a vertical blanking period at the automatic blanking detection circuit;

means for generating a vertical blanking signal using the automatic blanking detection circuit in response to the occurrence of the vertical blanking period;

means for generating a timing signal during the vertical blanking period using a timing circuit internal to the automatic blanking detection circuit;

means for counting a predetermined lockout period in response to the timing signal; and means for locking out the DE signal during the lockout period.

21. The apparatus of claim 20, wherein the lockout period is programmable.

* * * * *